US005718659A

United States Patent [19]

Van Straaten

[11] Patent Number: 5,718,659

[45] Date of Patent: Feb. 17, 1998

[54] EXERCISING MACHINE

[76] Inventor: Willem Johannes Van Straaten, 49 Trafalgar Street, Sandhurst, Johannesburg, South Africa

[21] Appl. No.: 612,682

[22] Filed: Mar. 8, 1996

Related U.S. Application Data

[63] Continuation-in-part of Ser. No. 596,429, Feb. 2, 1996, abandoned, which is a continuation-in-part of Ser. No. 572,610, Dec. 14, 1995, abandoned.

[30] Foreign Application Priority Data

Jul. 14, 1995 [ZA] South Africa ..... 95/5877

[51] Int. Cl.[6] ..... A63B 21/04

[52] U.S. Cl. ..... 482/130; 482/137; 482/133

[58] Field of Search ..... 422/121, 122, 422/123, 129, 130, 138, 133

[56] References Cited

U.S. PATENT DOCUMENTS

| | | | |
|---|---|---|---|
| 399,699 | 2/1889 | Sachs . | |
| 4,826,157 | 5/1989 | Fitzpatrick | 482/133 |
| 5,090,694 | 2/1992 | Pauls et al. . | |
| 5,176,601 | 1/1993 | Reynolds . | |
| 5,211,617 | 5/1993 | Millen . | |
| 5,277,684 | 1/1994 | Harris . | |
| 5,403,257 | 4/1995 | Lehtonen | 482/130 |

*Primary Examiner*—Lynne A. Reichard
*Attorney, Agent, or Firm*—Birch, Stewart, Kolasch & Birch, LLP

[57] ABSTRACT

The exercising machine includes a free-standing support structure that has first and second pivotally interconnected legs. Each leg has an upper and a lower leg with a foot at the lower end of each leg. In the operative state of the machine, the form an free-standing, inverted y-shape with the feet on the ground. For compact storage, the second leg can be pivoted alongside the first leg. In addition there is a seat which is pivotally connected relative to the first leg so as to move between an operative condition in which it projects laterally from the first leg and an inoperative condition in which the seat lies alongside the first leg, once again for storage purposes. There is a backrest on the first leg above the seat. A cross-bar spans across the upper end of the first leg at a horizontal attitude and elastic resistance elements are supported by ends of the cross-bar on either side of the first leg. A guide arrangement guides the elastic resistance elements so that they are selectively accessible to a person seated on the seat, at different elevations above and below the seat and on either side of the seat. This enables the person to perform a wide range of different exercises by gripping the elastic elements and stretching them against their resilience. In one version of the invention, the guide arrangement includes arms pivoted to the cross-bar with the resistance elements being attached to the ends of the arms. In another version of the invention, the cross-bar is rigid.

6 Claims, 5 Drawing Sheets

EXERCISING MACHINE

This application is a continuation-in-part of U.S. patent application Ser. No. 08/596,429 filed Feb. 2, 1996 now abandoned which is a continuation in part of U.S. patent application Ser. No. 08/572,610 filed Dec. 14, 1995 now abandoned.

BACKGROUND TO THE INVENTION

THIS invention relates to an exercise machine of the type which can be used to perform a range of exercises.

As is well known, there are many different types of exercise machines. There is a growing demand for these machines for domestic use and as such the machines should be relatively compact, easily stowable, but preferably be able to be used for performing a wide range of different exercises. The object of this invention is to provide an exercising machine which is suitable for domestic use and which can be used to perform a wide range of exercises.

SUMMARY OF THE INVENTION

According to one aspect of the invention there is provided an exercising machine comprising:

a support member supported via support means at an elevated position;

a pivotal connection mounted to or adjacent the support member, said pivotal connection having a generally horizontal pivot axis which is aligned generally parallel to the shoulders of a person operatively supported on the support member;

a pair of exercise support arms located on opposite sides of the support member and connected to the support member through the pivotal connection, said exercise support arms being rotatable through an arc on either side of the support member on said pivot axis and being selectively securable against rotation in different positions of rotation; and resistive force means located on the distal ends of the exercise support arms against which a person will work to perform exercises.

Preferably the support member comprises a seat which has a backrest connected thereto and the pivotal connection is located at or near the operatively upper end of the backrest.

The arms are preferably connected together so as to rotate in unison relative to the support member. The arms are preferably rotatable through a 360° arc and are preferably lockable in at least four different positions of said arc. Generally it is envisaged that the arms will be lockable in an upward pointing direction, in a forward pointing direction, in a downward pointing direction and in a rearward pointing direction.

The resistive force means may comprise one or more elastomeric bands. The bands may be connected between the distal ends of the arms and the pivotal connection. The machine preferably includes a pair of handles, one for each arm, and the elastomeric bands may be selectively coupled to the handles to vary the resistive force on the respective handles.

The support means may comprise a pair of legs which are foldable to a collapsed condition. In addition, the seat itself may be foldable to a collapsed condition to allow for easy stowing of the device.

According to another aspect of the invention there is provided an exercising machine comprising:

a free-standing support structure comprising:

first and second pivotally interconnected legs each having an upper and a lower end and a foot at the lower end, the legs in an operative condition of the support structure forming an free-standing, inverted y-shape with the feet engaging the ground, and the second leg being pivotable alongside the first leg in an inoperative condition of the support structure, a seat which is pivotally connected relative to the first leg for movement between an operative condition in which the seat projects laterally from the first leg between the ends of the first leg and an inoperative condition in which the seat lies alongside the first leg, a backrest on the first leg above the seat, and a cross-bar spanning across the upper end of the first leg at an orientation generally parallel to the shoulders of a person seated on the seat;

elastic resistance elements which are supported by ends of the cross-bar on either side of the first leg; and guide means for guiding the elastic resistance elements so that they are selectively accessible to a person seated on the seat, at at least two different elevations respectively above and below the seat and on either side of the seat, thereby enabling the person to perform different types of exercises by gripping the elastic elements and stretching them against their resilience.

The cross-bar may be rotatably mounted to the upper end of the leg or it may be fixed rigidly to the upper end of the first leg, the elastic resistance elements being supported at the ends of the cross-bar.

The elastic resistance elements are typically in the form of elastomeric bands and, in the case of a rigidly mounted cross-bar, the bands can extend from first pulleys at the ends of the cross-bar to corresponding second pulleys mounted on the foot of the first leg. The bands may in addition pass, between the first and second pulleys, around third pulleys mounted on the foot of the second leg.

There may be a slide member which is mounted on the first leg for sliding movement on the first leg between selected positions along the length of the first leg, the seat being connected pivotally to the slide member.

These and further features of the invention are described below with reference to the accompanying drawings. The drawings are, however, merely illustrative of how the invention may be put into effect so the specific components and features shown are not to be construed as limiting on the invention.

DETAILED DESCRIPTION

Figure 1:
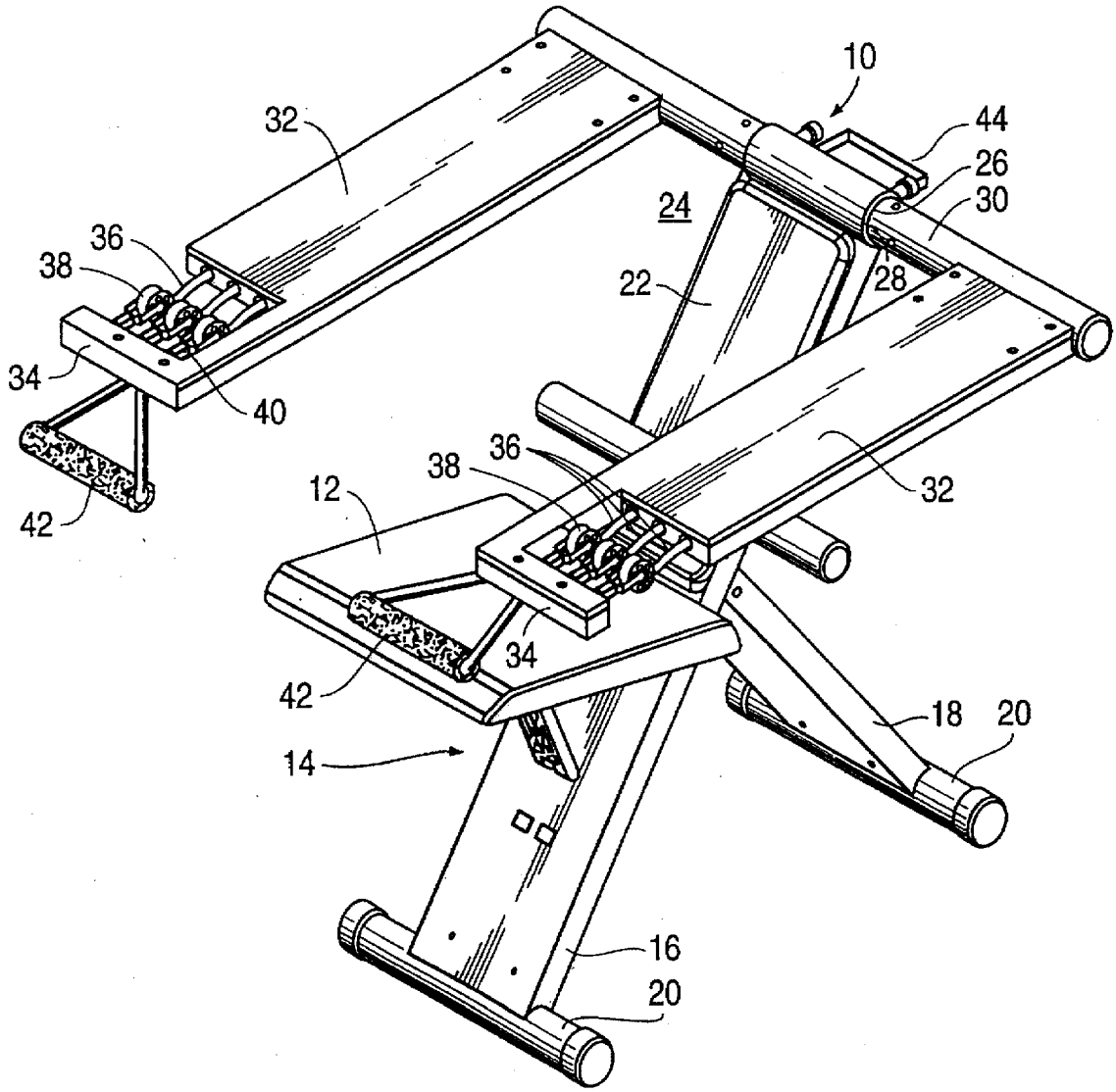
FIG. 1 shows a perspective view of an exercising machine according to one embodiment of the invention.

Referring initially to FIG. 1, an exercising device 10 comprises a generally horizontal seat 12 which is supported on a free-standing support structure 14 comprising a first leg 16 and a second leg 18. The legs 16 and 18 have ground-engaging feet 20 at their operatively lower ends and, in the operative condition seen in FIG. 1, the legs form an inverted y-shape. The leg 18 and the seat 12 are pivotally connected to the leg 16 and both can be collapsed against that leg for compact stowage purposes.

The seat is held at an operative, laterally extending orientation by a pivoted strut 50 which can engage the leg 16 at different positions to vary the orientation of the seat. Mounted on the leg 16 and extending upwardly and backwardly from the seat is a back rest 22. The term "back rest" as used herein is intended to indicate that part of the structure which is located behind and above the seat 12. Of course, a user need not actually rest against the back rest in any particular exercise and indeed it will be possible to construct the back rest quite differently so that it serves only a structural function as detailed herebelow.

At the upper end 24 of the back rest a pivotal connection 26 is formed. The pivotal connection comprises a bearing 28 in which a cross-bar, forming part of the support structure 14, in this case in the form of a shaft 30, is rotatably mounted, the shaft 30 extending laterally from either side of the back rest 22 and lying generally horizontally.

In this embodiment, a pair of arms 32 are mounted to the free ends of the shaft 30 and are perpendicular to the shaft 30 so that the arms 32 are positioned on either side of the seat 12. The arms 32 carry short brackets 34 on the free ends thereof and a plurality of elastic resistance elements, in this case in the form of elastomeric bands 36, extend inside the arms 32 between the bracket 34 and the relevant end of the shaft 30. The free ends of the bands adjacent to the brackets 34 pass around pulleys 38 and each of the bands has a connector 40 on the end thereof adjacent to the bracket 34 to which a handle 42 is connectable in conventional fashion. In practice, the bands 36 may be connected to the shaft 30. Alternatively each band may extend from a free end at one bracket 38, through the associated arm 32, through the shaft 30 and through the other arm 32 to terminate at the other bracket 38, with appropriate pulleys or other direction changing elements to guide the band from the relevant arm into the shaft and from the shaft into the other arm. The handle 42 can be connected to any one, or more than one, of the bands 36 so that by varying the number of bands connected to the handle 42 the worst required to pull the handles 42 against the action of the elastomeric bands 36 will be varied.

Figure 2:
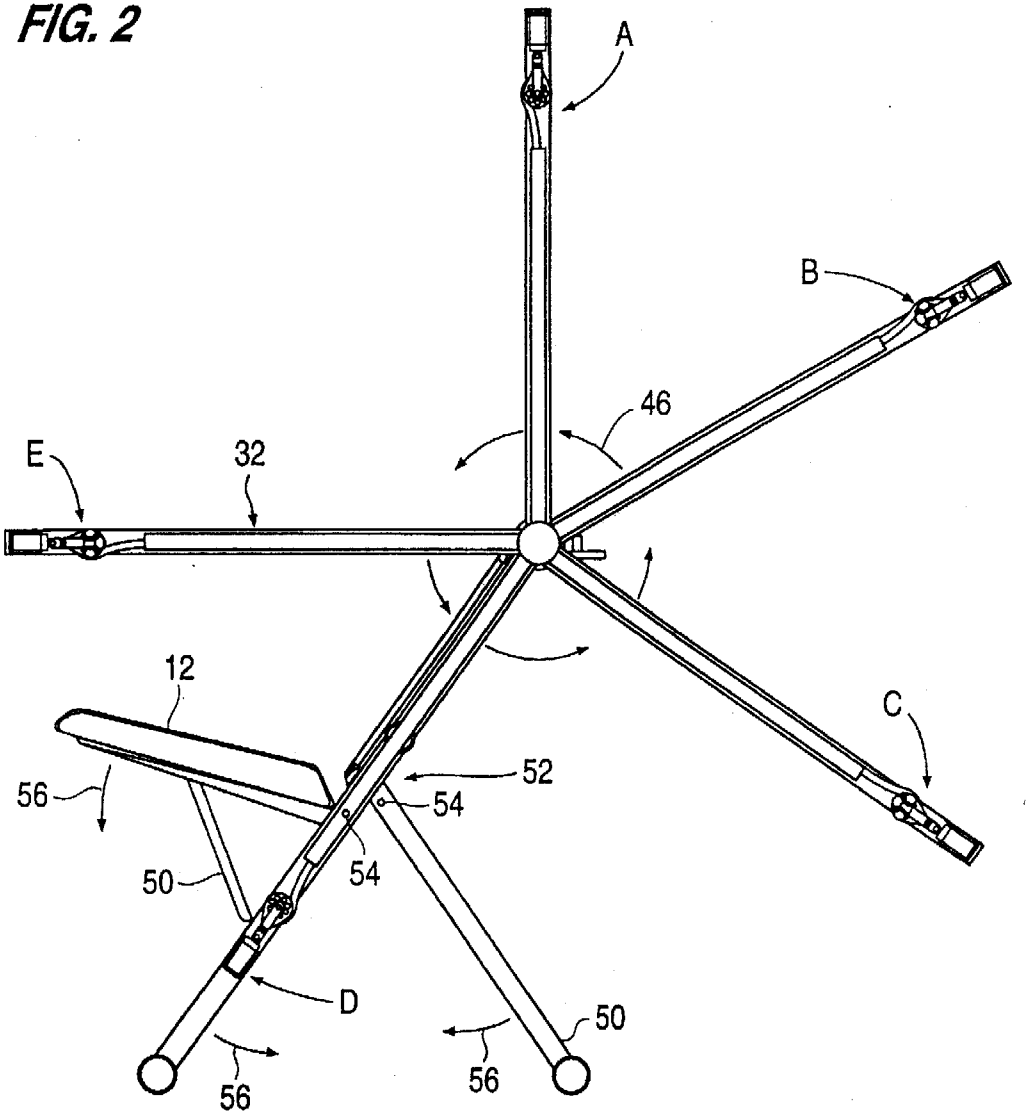
FIG. 2 shows a side view of the exercising machine shown in FIG. 1 depicting the movement of the arms of the exercising machine.

As previously mentioned, the shaft 30 is rotatable in the bearing 28 relative to the back rest 22. The shaft 30 is, however, lockable against rotation by a locking mechanism, which is not shown but which could, for instance make use of locking pin(s) engaging the shaft and bearing 28, which can be released by a release button 44 located in the end 24 of the back rest. It is envisaged that the shaft 30 will be lockable in at least five positions as indicated by letters A, B, C, D and E in FIG. 2 of the drawings. The shaft 30 is however rotatable, as indicated by arrows 46, in FIG. 2 through a full 360° rotational arc. If desired the locking mechanism could be designed to lock the rod 30 and hence arms 32 in positions other than the positions A, B, C, D and E, or in additional positions.

Figure 3:
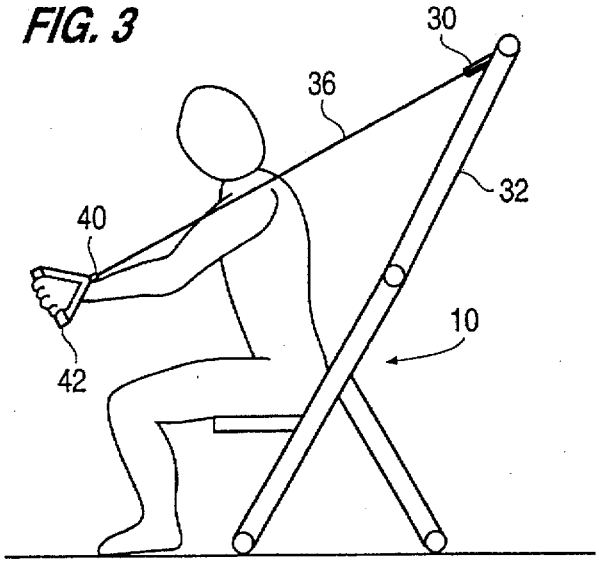
FIGS. 3, 4 & 5 depict different exercises that can be performed using the machine of FIG. 1.
Figure 4:
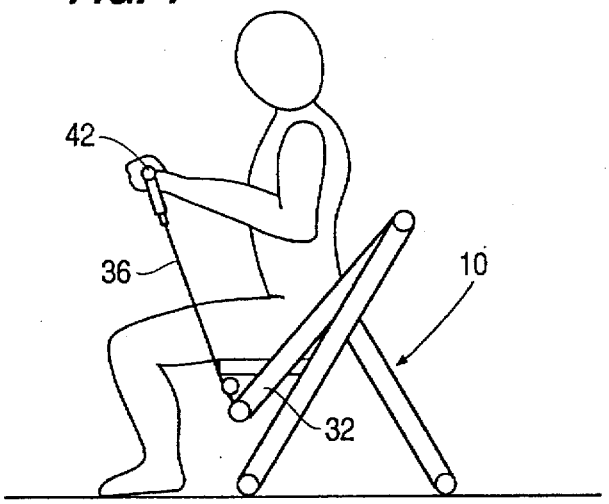
Figure 5:
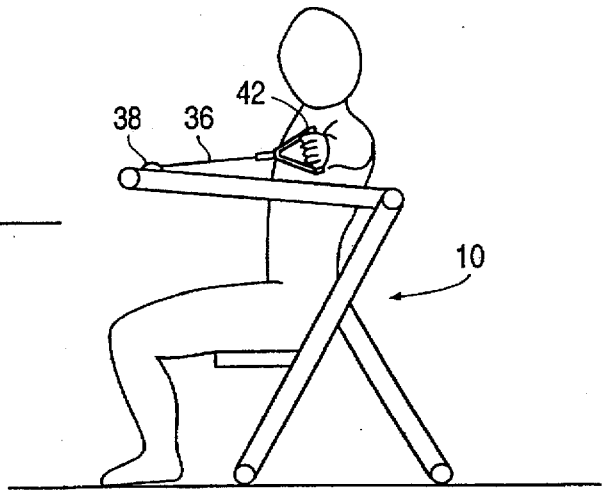

As indicated in FIGS. 3, 4 and 5, a few of the different exercises that can be undertaken using the exercising machine 10. These different exercises will be apparent to one skilled in the art but it will be immediately apparent that, depending on the position of the arms 32, different muscle groups will be exercised by pulling on the handles 42 to against the action of the elastomeric bands 36 i.e. by stretching the bands against their resilience. Mainly it will be the upper body muscles exercised using the machine although with the arms in a low position such as the position D in FIG. 4 the handles, or alternatively ankle cuffs, could be connected to the legs of the user and leg exercises could also be done. These are but examples of the types of exercises which could be done using the exercising machine 10. A user could also exercise facing the backrest which would also increase the range of exercises which could be performed with the machine.

It will be appreciated that the arms 32 and shaft 30, together with the pulleys provide a guide arrangement which enables the free ends of the bands to be located selectively, at the option of the user, at various elevations both above and below the level of the seat 12, thereby contributing to the very wide range of useful exercises which can be performed with the machine.

Figure 6:
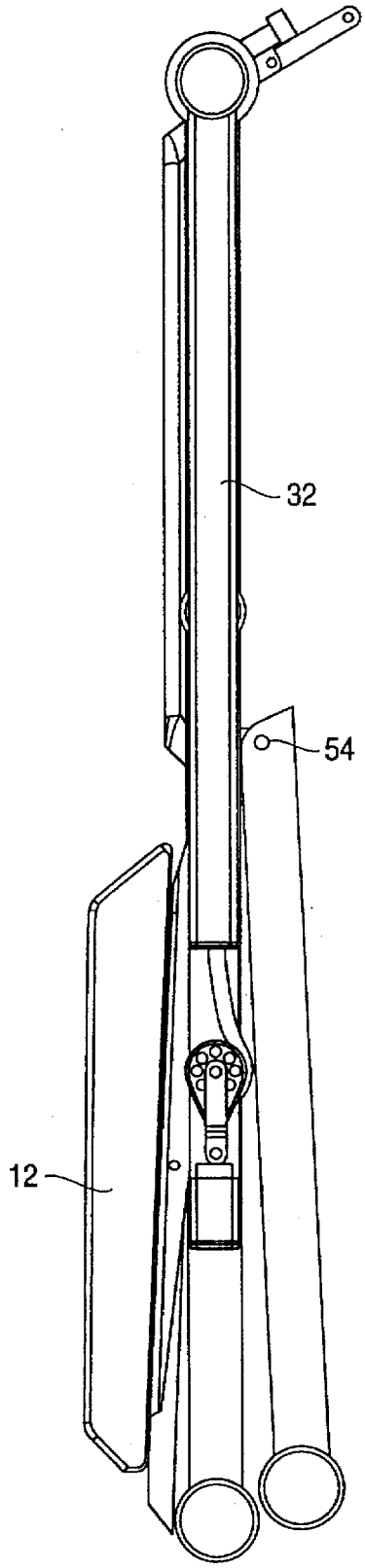
FIG. 6 shows a side view of the machine of FIG. 1 in a collapsed configuration.

The apparatus shown in FIGS. 1 to 6 can clearly be folded to a very compact size. The different elements are hinged together about a central region 52 via hinges 54. As indicated by the arrows 56 in FIG. 2 the whole device can be caused to fold to a relatively small size which can easily be stowed in the boot of a motor car, in a cupboard, or a like stowage location. FIG. 6 depicts the machine in its folded condition. It will be noted that all components are generally parallel to each other so that the machine is generally flat. This will allow for easy storage behind a door or in a cupboard, for example.

Figure 7:
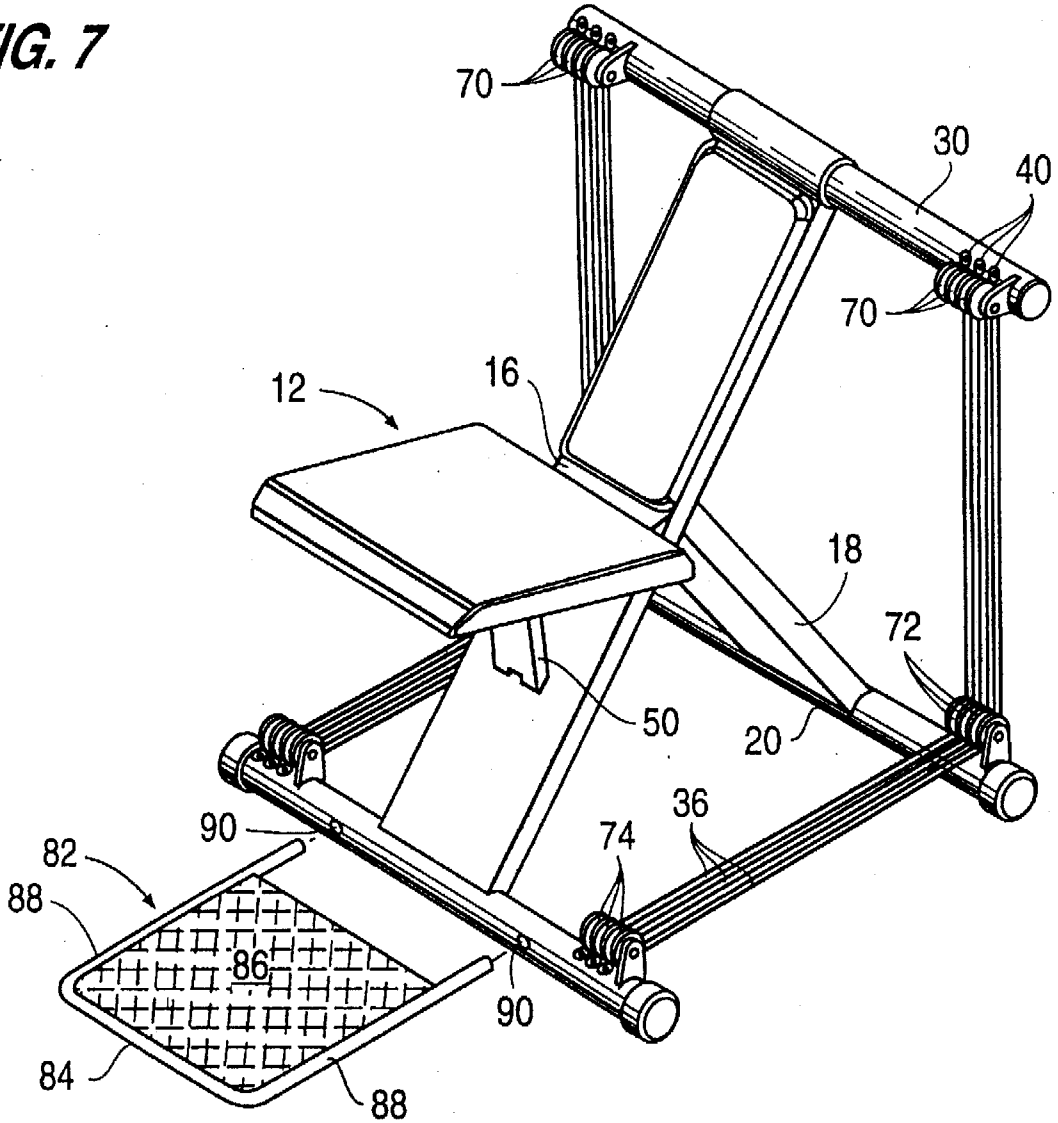
FIG. 7 shows a perspective view of an exercising machine according to a second embodiment of the invention.

FIG. 7 illustrates another embodiment of the invention. In this Figure, components corresponding to those of FIGS. 1 to 6 are designated with like numerals.

In FIG. 7, the cross-bar 30 is fixed non-rotatably to the upper end of the leg 16. As with the cross-bar or shaft 30 in the first embodiment, this cross-bar spans across the upper end of the leg 16 at an orientation which will be generally parallel to the shoulders of a person seated on the seat 12, i.e. at a horizontal orientation. Three pulleys 70 are attached to each end of the cross-bar 30. Lying in the same vertical plane as the pulleys 70 at each end of the cross bar are three pulleys 72 on the foot 20 of the leg 18 and three pulleys 74 on the foot 20 of the leg 16. The elastic resistance bands 36 in this case extend as illustrated from a free end adjacent the cross-bar 30, around the pulleys 72 and terminate adjacent the foot 20 of the leg 16. At each free end, each band carries a connector 40 to which a handle, similar to the handles 42, can be connected. As described previously, a single handle can be connected to any one or more of the bands to allow the user to select the elastic resistance against which to exercise. In practice, the bands themselves may have different strengths, thereby providing the user with an even wider range of exercise resistances to choose from.

It will be appreciated in FIG. 7 that, as in the first embodiment, the guide arrangement for the bands 36 renders the bands selectively accessible by the user at two different elevations, namely at the level of the cross-bar 30 and at the level of the foot 20 of the leg 16. At their free ends adjacent the foot of the leg 16, an ankle cuff as opposed to a handle may be connected to the band(s) to enable the user to perform leg exercises.

It will be appreciated that the embodiment of FIG. 7 can also be folded up compactly for storage purposes, merely by collapsing the seat 12, leg 18 and strut 78 against the leg 16. In this case, the bands 36 will merely lie in a loose configuration alongside the collapsed rigid components.

In a variation of the FIG. 7 embodiment, not illustrated, the bands could extend directly from the pulleys 70 to the pulleys 74, the pulleys 72 being omitted. In general, however, the illustrated arrangement is preferable in this regard since it provides a greater length of band and hence a greater stretched length, thereby permitting exercising movements to take place through a greater distance. In yet another variation, not illustrated, the bands could extend from the pulleys 70, through or alongside the cross-bar 30, through or alongside the leg 16, and through or alongside the foot 20 of the leg 16 to the pulleys 74. In this case appropriate direction changing elements, typically further pulleys, would be provided at each change of direction. The end result would be a somewhat neater configuration than that illustrated.

Figure 8:
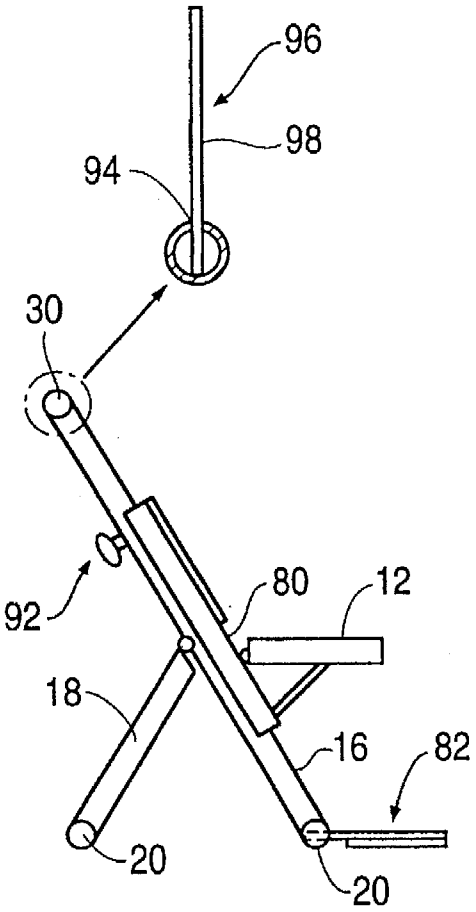
FIG. 8 diagrammatically illustrates a modification of the embodiment seen in FIG. 7.

FIG. 8 diagrammatically illustrates the support structure 14 of yet another modification to the embodiment of FIG. 7. In this case, the seat is not pivoted directly to the leg 16, but to a slide member 80 on which the padded section of the back rest is also mounted. The slide member 80 can be slipped up or down the leg 16 to an elevation selected by the user, and means (not shown, but typically including a pin which engages the slide and a selected one of a series of holes in the leg 16) are provided to anchor the slide member and hence the seat and padded section of the back rest at the selected elevation. With this arrangement, the user can, for instance, drop the seat to a low level so that the pulleys 70 are well above his shoulders. This feature further increases the range of possible exercises that can be performed with the machine.

FIGS. 7 and 8 also illustrate other preferred modifications to the exercising machine of the invention. As shown in these Figures, the machine includes a footplate 82 which comprises a U-shaped bar 84 and a plate 86 of rigid material spanning between the legs 88 of the bar. The foot 20 is formed with holes 90 at the same spacing as the legs 88. When the machine is assembled the ends of the legs 88 are slipped into the holes 90 so that the footplate extends forwardly from the leg 20, as seen in FIG. 8.

The footplate 82 has a dual purpose. Firstly, it provides extra stability for the machine in use. If the user should, for instance, be seated near to the front edge of the seat 12 with the result that his centre of gravity is in a forward position, there is a danger with some exercises that the machine may tip over forwardly. However this is not possible if the footplate 82 is fitted as described above.

Secondly, the user may stand on the footplate 82, thereby anchoring the exercising machine to the ground. The user may, for instance, wish to stand on the footplate, rather than sitting on the seat 12, in order to perform certain exercises. In such cases, the handles attached to the elastic resistance bands 36 adjacent the foot 20 can be grasped by the user who can then perform squat or other selected exercises. It will thus be appreciated that the provision of the footplate will increase the range of exercises which are available to the user.

Another modification which is illustrated in FIG. 8 is a mushroom-shaped knob 92 which is fixed to and projects rearwardly from the centre of the leg 16. This knob serves as an anchorage point for the elastic resistance bands 36 when the machine is collapsed to an inoperative position. It will be appreciated that in the absence of any appropriate anchorage, the elastic resistance bands would be loose and capable of entanglement with one another when the machine is collapsed. To avoid this, the bands 36 on the side of the machine are, prior to collapse of the machine, stretched over the opposite side of the knob 92 so as to bear against the stem of the knob beneath the enlarged head thereof. In similar fashion, the bands 36 from the other side of the machine are stretched over the knob in the opposite direction. The bands thus cross over one another to opposite sides of the knob. The geometry is such that the bands are maintained in a taut state even when the machine is subsequently collapsed. In this way, possible entanglement of the bands is avoided. When the machine is again to be used, it is a simple matter to erect it to the operative state and detach the bands from the opposite sides of the knob. The bands will then revert to the FIG. 7 configuration under their natural elasticity, ready for use.

FIG. 8 illustrates yet another modification to the machine. In this case, a slot 94 of appropriate length is formed in the upper surface of the cross-bar 30. A rigid board 96 of rectangular shape is provided. On its major surface 98 the board contains an exercise programme which, with the aid of written text and possibly illustrative diagrams, describes to the user how to perform the many exercises which are possible with the machine. The board may, for instance, give a description of one or more particular sequences of exercises which the user should perform. When the machine has been erected to the operative state, the lower edge of the rectangular programme board can be slipped into the slot 94 which accommodates it snugly and which retains it at an upright attitude where the programme information which it carries will be readily visible at all times to the user. When the machine is collapsed to the compact, non-operative configuration the board is merely withdrawn from the slot and is stored alongside the remainder of the machine.

In FIG. 7 the cross-bar is shown to extend in fixed manner through a sleeve connected to the upper end of the leg 16. To accommodate the programme board, the sleeve may be omitted, with the cross-bar then being fixed directly to the upper end of the leg and with the slot 94 formed in the cross-bar.

These modifications could of course be incorporated in the first embodiment.

I claim:

1. An exercise machine comprising:

a free-standing support structure comprising:

first and second pivotally interconnected legs each having an upper and a lower end and a foot at the lower end, the legs in an operative condition of the support structure forming a free-standing, inverted "y"-shape with the feet engaging the ground, and the second leg being pivotable alongside the first leg in an inoperative condition of the support structure, a seat which is pivotally connected relative to the first leg for movement between an operative condition in which the seat projects laterally from the first leg between the ends of the first leg and an inoperative condition in which the seat lies alongside the first leg, a backrest on the first leg above the seat, and a substantially horizontal cross-bar fixed rigidly to and spanning across the upper end of the first leg;

first pulleys mounted on the cross-bar on either side of the first leg;

second pulleys mounted on the foot of the first leg on either side of the first leg;

elastic bands which extend about the first pulleys and the second pulleys so that respective ends of the bands are selectively accessible to a person seated on the seat, at at least two different elevations respectively above and below the seat and on either side of the seat, thereby enabling the person to perform different types of exercises by stretching the elastic bands against their resilience.

2. An exercising machine according to claim 1 wherein the elastic bands pass, between the first and second pulleys, around third pulleys mounted on the foot of the second leg.

3. An exercising machine according to claim 1 comprising a slide member which is mounted on the first leg for sliding movement on the first leg between selected positions along the length of the first leg, the seat being connected pivotally to the slide member.

4. An exercising machine according to claim 1 and comprising a footplate which is connectable to the foot of said first leg, the footplate when so connected to said foot in an operative condition of the support structure extending laterally from said foot on the ground.

5. An exercising machine according to claim 1 and comprising an anchoring device projecting from said first leg, the elastic bands being stretchable over the anchoring device which thereby maintains the elastic bands in a taut condition when the support structure is in an inoperative condition.

6. An exercising machine according to claim 1 and comprising a programme board carrying indicia describing exercises which can be performed on the machine, the cross-bar being formed with a slot to receive an edge of the programme board, thereby to maintain the programme board at an upright attitude, when the support structure is operative, with the indicia visible to a user of the machine.

* * * * *